169-44 SR
8/15/78 OR 4,106,566

United States Patent [19]
Dion-Biro

[11] 4,106,566
[45] Aug. 15, 1978

[54] PROCESS FOR THE UTILIZATION OF LOW AND MEDIUM EXPANDED FOAM FOR THE EXTINCTION OF FIRES FROM LIQUEFIED PRODUCTS

[75] Inventor: Guy Dion-Biro, Vincennes, France

[73] Assignee: Biro Fils, Paris, France

[21] Appl. No.: 711,085

[22] Filed: Aug. 2, 1976

[51] Int. Cl.[2] ..... A62C 1/12; A62C 31/12
[52] U.S. Cl. ..... 169/44; 169/69; 169/15; 239/422; 239/433
[58] Field of Search ..... 169/43–47, 169/66, 68, 69, 5, 14, 15; 239/312, 343, 422, 423, 433, 428

[56] References Cited

U.S. PATENT DOCUMENTS 3,090,444 5/1963 Bandiroli ..... 169/15

*Primary Examiner*—Evon C. Blunk
*Assistant Examiner*—Andres Kashnikow
*Attorney, Agent, or Firm*—Haseltine, Lake & Waters

[57] ABSTRACT

A process for the simultaneous utilization of low expanded foam and medium expanded foam produced by respective generators thereof, for the extinction of fires, from liquefied gas comprising transporting the medium expanded foam by the faster traveling low expanded foam in order to provide a high velocity of flow of the medium expanded foam. The low expanded foam is produced by a plurality of generators disposed beneath a single generator of medium expanded foam and inclined with respect thereto to direct the jets of low expanded foam into the lower part of the jet of medium expanded foam.

2 Claims, 2 Drawing Figures

PROCESS FOR THE UTILIZATION OF LOW AND MEDIUM EXPANDED FOAM FOR THE EXTINCTION OF FIRES FROM LIQUEFIED PRODUCTS

FIELD OF THE INVENTION

The present invention relates to a process for obtaining a medium expanded foam adapted for extinguishing fires from liquefied products, for example, butane, propane-methane or the like, in the liquid state at atmospheric pressure (which is only possible below 0° C.).

BACKGROUND OF THE INVENTION

When such liquefied products are ignited, all give up water with a release of heat which intensifies the gaseous release of the product and provokes an increase of flame. Previously, the foams employed for extinction of fires were thus hardly effective.

There has been used to remedy this disadvantage a product and a system for obtaining a maximum amount of foam from a minimum amount of water, an expansion of one hundred to three hundred times the initial volume being obtained, a greater expansion producing a foam which is too light and can be carried away by the convection currents produced by the fire. Unfortunately, in practice to obtain such expansion, it is necessary to employ the major portion of the available energy (discharge pressure) whereby there is no longer sufficient energy to obtain the necessary range for manual use. Because of this fact, the utilization of a mobile material remains impossible for large discharges.

There has also been tried the utilization of foam called "low expanded foam" that is to say representing six to ten times the initial volume. In this case, the transformation of energy is relatively low which permits obtaining an appreciable range for an ordinary incendiary fire. However, with respect to a liquid gas fire, at low temperature, this solution produces a release of water, therefore of heat, so significant taking into account what is tolerable, that extinction of the fire is rendered impossible because of the transformation of the liquid to gas. The application of the above two foam products, therefore, remains very limited, the first lacking the range, the second giving up too much heat by the presence of water in great quantity.

SUMMARY OF THE INVENTION

The present invention contemplates the simultaneous utilization of low expanded foam and medium expanded foam, the process being characterized in that the medium expanded foam is carried by the low expanded foam to the fire.

Such result is obtained by disposing low expanding foam generators along an arc of a circle around a medium expanding foam generator.

Such an arrangement presents a difficulty due to the enormous differences of speeds at the outlet of the low expanded foam generators, the low expanded foam destroying a great portion of the medium expanded foam even through a number of generators are disposed along the arc of a circle under the medium expanding foam generator in order that "holes" between the jets of low expanded foam be as reduced as possible. In fact, the number of necessary low expanded foam generators is such that the sum of their discharges is greater or at least equal to the discharge of the medium expanded foam generator.

In accordance with the invention, there has been an increase of the expansion of the low expanding foam generators in order to achieve an expansion of between 15 and 20 times the initial volume (instead of 6 to 10 times). Furthermore, an angle of intersection is provided between the two axes formed by the low expanding foam generators and the medium expanding foam generator, between 8° and 12° according to size, the outlet of the low expanding foam generators being additionally retracted by about 1/5 of the length of the medium expanding foam generator.

DETAILED DESCRIPTION OF THE DRAWING

Figure 1:
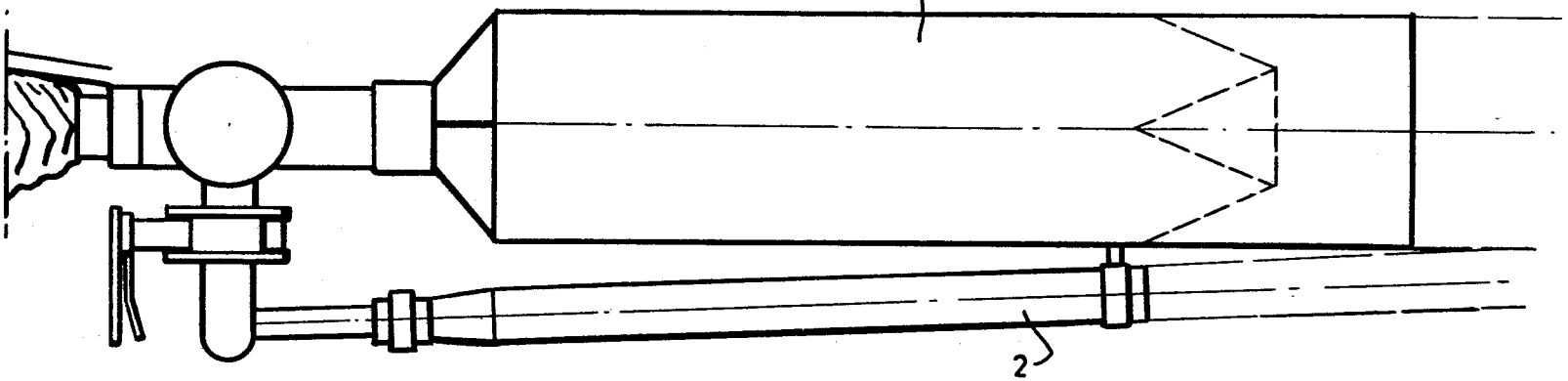
FIG. 1 is an elevation view of a generator according to the invention.
Figure 2:
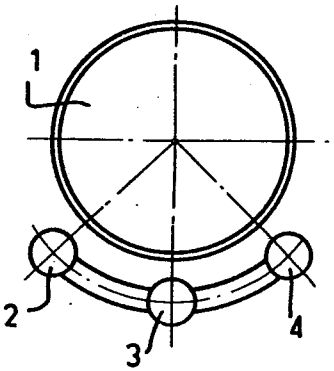
FIG. 2 is a front view of the generator of FIG. 1

In the annexed drawing, there is shown a generator assembly according to the invention comprising a medium expanding foam generator 1 below which are disposed three low expanding foam generators 2, 3 and 4 whose axes are inclined at an angle with respect to the axis of the generator 1 as evident from FIG. 1. In the particular illustration the angle is 8° and can vary between 8° and 12°.

The arrangement of the invention has the consequent advantage of making the relative flow speed of the thusly carried medium expanded foam very close to that of the low expanded foam, the jets of foam from the low expanding generators 2 acting to "slice" the lower portion of the skirt of the foam discharge from the medium expanding foam generator 1 whereby the medium expanded foam is transported on a layer of low expanded foam thus permitting a multiplication by ten of the initial range of the said medium expanding generator, while avoiding exposure of the operator to the heat from the source and diminishing the discharge of water from the low expanding foam generators. This arrangement can, therefore, be utilized against fires of liquefied products, where the release of heat is substantial by a mobile material having a high discharge rate.

What is claimed is:

1. A process for the simultaneous utilization of low expanded foam and medium expanded foam from respective generators thereof for the extinction of fires from liquefied gas and other burnable substances, said low expanded and medium expanded foams being relatively faster and slower traveling, said process comprising directing a plurality of jets of low expanded foam in a circular arrangement beneath a jet of medium expanded foam such that the jets of low expanded foam and the jet of medium expanded foam are inclined at angles between 8° and 12°, transporting the medium expanded foam by the faster traveling low expanded foam in order to provide a high velocity of flow and a greater range of the medium expanded foam, the jets of low expanded foam being set back from the jet of medium expanded foam for slicing off a lower portion of the jet of medium expanded foam.

2. A process as claimed in claim 1 wherein the low expanded foam is expanded by about 15 to 20 times the initial volume, thereof while the medium expanded foam is expanded 100 to 300 times.

* * * * *